US009341342B2

(12) United States Patent
Chiang

(10) Patent No.: US 9,341,342 B2
(45) Date of Patent: May 17, 2016

(54) COLORED LENS LED SIMULATED WICK FLAMELESS CANDLE

(71) Applicant: Young March Co., Ltd., Irvine, CA (US)

(72) Inventor: Hsui Ching Chiang, Ludao Township (TW)

(73) Assignee: Young March Co., Ltd., Irvine, CA (US)

( * ) Notice: Subject to any disclaimer, the term of this patent is extended or adjusted under 35 U.S.C. 154(b) by 0 days.

(21) Appl. No.: 14/047,721

(22) Filed: Oct. 7, 2013

(65) Prior Publication Data

US 2014/0104820 A1 Apr. 17, 2014

Related U.S. Application Data

(60) Provisional application No. 61/711,343, filed on Oct. 9, 2012.

(51) Int. Cl.

| | |
|---|---|
| ***F21V 13/02*** | (2006.01) |
| ***F21L 4/00*** | (2006.01) |
| ***F21L 4/08*** | (2006.01) |
| ***F21S 9/02*** | (2006.01) |
| ***F21S 10/04*** | (2006.01) |
| *F21S 6/00* | (2006.01) |
| *F21W 121/00* | (2006.01) |
| *F21Y 101/02* | (2006.01) |

(52) U.S. Cl.

CPC . *F21V 13/02* (2013.01); *F21L 4/00* (2013.01); *F21L 4/08* (2013.01); *F21S 9/02* (2013.01); *F21S 10/04* (2013.01); *F21S 6/001* (2013.01); *F21W 2121/00* (2013.01); *F21Y 2101/02* (2013.01)

(58) Field of Classification Search

CPC ..... F21L 4/00; F21S 10/04; F21S 6/001; F21S 9/02; F21V 13/02; F21W 2121/00; F21Y 2101/02

USPC ..... 362/183, 157, 392

See application file for complete search history.

(56) References Cited

U.S. PATENT DOCUMENTS 1,842,167 A * 1/1932 Hall ..... 313/273
5,924,784 A 7/1999 Chliwnyj et al.

(Continued)

FOREIGN PATENT DOCUMENTS

AU 2004100922 A * 12/2004
CN 302311116 S 1/2013

(Continued)

*Primary Examiner* — Anne Hines

(74) *Attorney, Agent, or Firm* — Knobbe, Martins, Olson & Bear, LLP

(57) ABSTRACT

A battery powered device simulating a traditional wick burning candle through the combined use of a colored lens LED, electronic circuit board and integrated chip to control the flicker pattern of the said LED. The battery compartment and electronic circuits are contained within an internal housing which is placed within the body of a simulated candle shell. The colored lens LED is extended through an opening in the upper portion of the candle shell. Switches to operate the said device are placed on the bottom base of the internal housing, which is exposed on the bottom of the candle. The colored lens of the LED is such that it is light enough not to significantly impair light performance while appearing black or almost black, effectively simulating a blackened wick, when not illuminated.

20 Claims, 4 Drawing Sheets

(56) References Cited

U.S. PATENT DOCUMENTS

| | | | | |
|---|---|---|---|---|
| 6,616,308 | B2 | 9/2003 | Jensen et al. | |
| 6,719,443 | B2 | 4/2004 | Gutstein et al. | |
| 7,125,142 | B2 * | 10/2006 | Wainwright | 362/231 |
| 7,201,500 | B2 | 4/2007 | Mishan | |
| 7,360,935 | B2 | 4/2008 | Jensen et al. | |
| 7,824,627 | B2 * | 11/2010 | Michaels et al. | 422/128 |
| 7,828,462 | B2 | 11/2010 | Jensen et al. | |
| 8,371,740 | B2 | 2/2013 | Pestl et al. | |
| 8,412,029 | B2 | 4/2013 | Browder et al. | |
| 8,724,975 | B2 | 5/2014 | Browder et al. | |
| 8,926,137 | B2 | 1/2015 | Li | |
| 2005/0254248 | A1 * | 11/2005 | Lederer | 362/392 |
| 2007/0091633 | A1 | 4/2007 | Harrity et al. | |
| 2008/0074875 | A1 * | 3/2008 | Jensen et al. | 362/240 |
| 2008/0130266 | A1 | 6/2008 | Dewitt et al. | |
| 2008/0150453 | A1 | 6/2008 | Medley et al. | |
| 2010/0079999 | A1 * | 4/2010 | Schnuckle | 362/253 |
| 2010/0124050 | A1 * | 5/2010 | Hau et al. | 362/183 |
| 2010/0290238 | A1 * | 11/2010 | Howard | 362/392 |
| 2011/0204828 | A1 | 8/2011 | Moody et al. | |
| 2011/0317403 | A1 * | 12/2011 | Fournier et al. | 362/183 |
| 2012/0183280 | A1 | 7/2012 | Kowalec et al. | |
| 2014/0098532 | A1 | 4/2014 | Chiang | |
| 2014/0340881 | A1 * | 11/2014 | Tsai | 362/190 |
| 2015/0036348 | A1 * | 2/2015 | Dong | 362/293 |

FOREIGN PATENT DOCUMENTS

| | | | |
|---|---|---|---|
| CN | 203147577 | U | 8/2013 |
| EP | 2 570 714 | A1 | 3/2013 |

* cited by examiner

COLORED LENS LED SIMULATED WICK FLAMELESS CANDLE

BACKGROUND OF THE INVENTION

1. Technical Field of the Invention

The present invention relates generally to battery operated LED (light emitting diode) candles, commonly referred to as "flameless candles", and in particular, to the LED of such candle using a colored lens which can simulate a blackened wick when the LED in not operating.

2. Description of the Related Art

Various configurations of LED flameless candles are known in prior art. Typically, such prior art devices use one (1) single diode LED concealed within a flame shaped cap, known as a "flamecap", or multiple LEDs which are usually exposed. It is also known that a prior art device simulates a blackened wick with a small plastic post that is placed in a position on the top of the candle shelf (the surface that simulates the upper level of the candle when the flame has burned away wax). In this particular design, the LED is placed within the body of the flameless candle. These prior art designs have drawbacks that limit their ability to achieve a more realistic simulation of a traditional wick burning candle. When the LED is concealed within a flamecap, there is a lack of realism when the device is not operating. The non-illuminated flame shaped cap does not have the appearance of a real candle at this point. Nor do exposed LEDs, such as with the multiple LED configuration, which usually exposes clear LEDs with no flamecap. Again, this configuration does not appear very realistic when the candle is not operating. The prior art design that uses the simulated blackened wick with the LED positioned within the body of the flameless candle does appear more realistic than other designs when the candle is not operating, however, because the LED is positioned within it does not appear realistic when the candle is operating.

The drawbacks mentioned above have not been adequately addressed by prior art. It is the intention of the present invention to remedy, at least in part, these deficiencies.

SUMMARY OF THE INVENTION

Accordingly, there is provided herein, in various embodiments, a flameless candle incorporating the use of a colored lens LED. The colored lens LED is mounted onto an internal housing that also contains electronic circuit components to control the aforementioned independent flickering of each diode within the LED. The internal housing also contains the batteries as well as various operational switches such as for power, timer functions and remote control among others. The internal housing ideally is positioned within an artificial candle shell, which may be constructed of wax, plastic, resin or other suitable material. Further, the location of the colored lens LED is such that it is below the top lip of the candle shell and above the partition of the candle shell and the top of the internal housing (referred to as the "shelf" in the industry). This exposes the position of the colored lens LED to the external portion of the candle shell while keeping it in a position to cast illumination through the side wall of the candle shell creating "glow" in the candle shell. The color of the LED lens is light enough that it does not noticeably impair light output while being dark enough that when the LED is not operating it appears to be black. Due to the cylindrical shape of the LED, it provides that appearance of a blackened wick when not operating, especially when viewed in position above the "shelf" of the flameless candle shell. Although the preferred design is to use an LED that possesses a colored lens as previously described, it is foreseen that it is possible to alternatively use a cylindrical cover over a traditional clear LED lens to achieve the same effect. The LED lens cover would be made to fit snuggly over the shape of an LED. The colored LED lens cover can be attached in a variety of methods including but not limited to gluing, snap fit, and screw on attachment.

In another aspect of the foregoing embodiment, the shape of the colored lens LED is concave. An LED is covered by a plastic lens. This lens not only protects the delicate electronic diode of the LED, but it is influential in determining the light pattern that is cast when the LED is operational. The colored lens LED will, preferably, use a concave shape lens. The lens contains an inverted cone design directly opposite of the location of the diode which effectively acts as a reflector to redirect light to the side of the LED rather than allowing it to project straight. The use of this shape LED lens improves the illumination and ambience of a flameless candle. Although the preferred design incorporates the use of a concave LED lens, it may be possible to use other lens shapes, such as the traditional dome shape, for other applications. In the preferred design, it is envisioned the use of 3 mm to 5 mm LEDs (measurement based on diameter measurement), although other sizes may be applicable depending on application. In another aspect of the invention, the flickering effect is controlled with an integrated chip (IC) built into the LED, which is the preferred embodiment of the present invention. It is also possible to develop an independent integrated chip that would not be positioned within the LED but rather placed on the electronic circuit board or other location to actuate a flickering pattern.

In another aspect of the invention, it is envisioned that power could be supplied by various means, including but not limited to, rechargeable batteries via removable A/C power adaptor, hard wired A/C power and solar power. It is also contemplated that the device could incorporate features such as a timer to allow for auto on and off operation, remote control to allow for operation of the candle unit from a distance, and light sensing technology to allow unit to automatically turn on whenever ambient light levels are sufficiently low.

In another aspect of the invention, it is envisioned the colored lens LED could be used in flameless candle shells made from wax, plastic, resin or any material capable of simulating a natural candle shell. This application is viable for flameless candles intended for use in both any indoor and outdoor application.

BRIEF DESCRIPTION OF THE SEVERAL VIEWS OF THE DRAWINGS

A more complete understanding of the invention may be had by reference to the following detailed description when taken in conjunction with the accompanying drawings, wherein.

Figure 1:
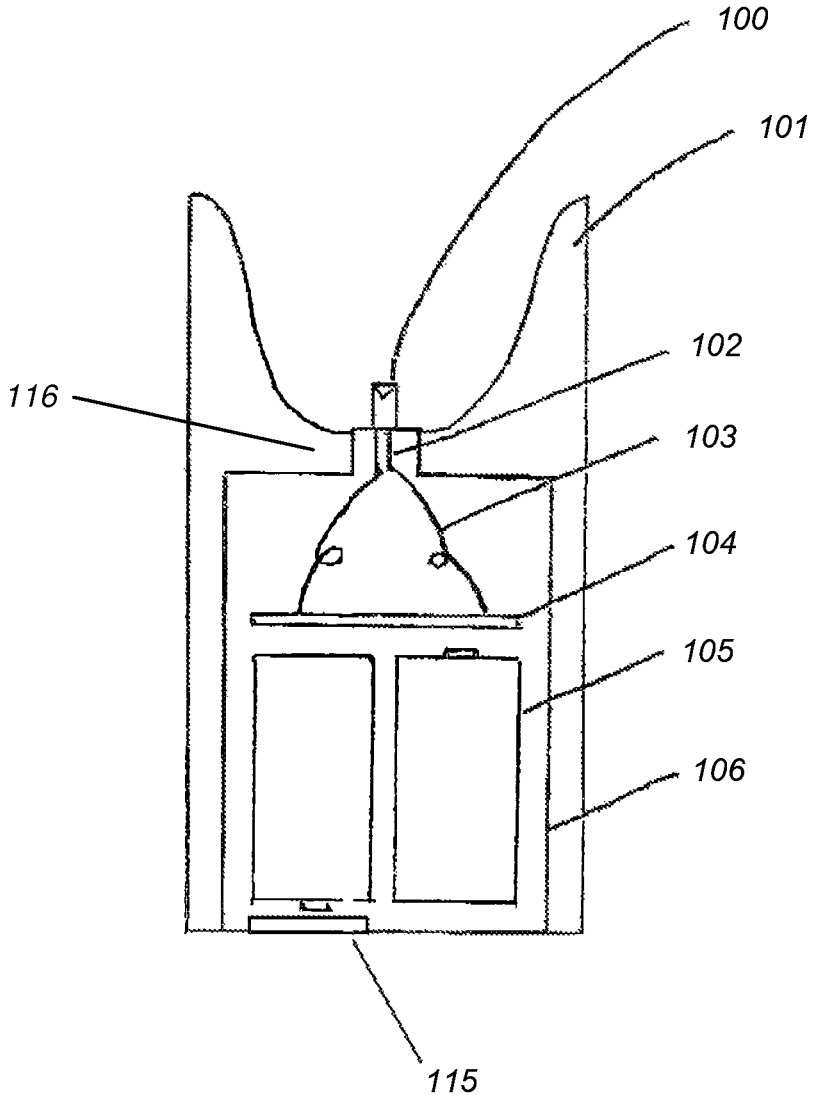
FIG. 1 shows a perspective and cut-away view of a preferred embodiment of the invention.

Where used in the various figures of the drawings, the same reference numerals designate the same or similar parts. Furthermore, when the terms "front," "back," "first," "second," "upper," "lower," "height," "top," "bottom," "outer," "inner," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will either be explained or will be within the skill of persons of ordinary skill in the art after the following teachings of the present invention have been read and understood. Further, the exact dimensions and dimensional proportions to conform to specific width, length, and similar requirements will likewise be within the skill of the art after the following teachings of the present invention have been read and understood.

Preferred embodiments of the colored lens LED flameless candle according to the present invention will now be described in detail with reference to the accompanying drawings.

DETAILED DESCRIPTION OF THE DRAWINGS

Referring to FIG. 1, a cross sectional view of a preferred embodiment of the colored lens LED flameless candle is shown. The colored lens LED (100) is attached to an internal housing (106). The anode and cathode leads (102) of the colored lens LED (100) are connected to an electronic circuit board (104) via wires (103) or via direct connection such as soldering (not shown). The internal housing (106) also contains the power source such as batteries (105) as well as operation switches mounted to a control unit (115). Collectively, these components are contained within the simulated candle shell (101) to complete the preferred embodiment of the device. The preferred embodiment of the present invention uses wax for the candle shell for a realistic simulation. It is also considered that plastic, resin or other suitable materials can be used to effectively simulate a candle shell. It is also considered that alternative embodiments of the device could include use of rechargeable batteries powered by a removable A/C power adaptor, be hard wired for A/C power or contain solar power panels. Likewise, those of ordinary skill in the art will recognize that other alternate embodiments of the invention intended primarily for outdoor use is possible as is alternative uses when combined with other lighting accessories associated with candle application such as lanterns, hurricanes, sconces, and chandeliers. As indicated above, and as is shown in FIG. 1, the LED can be located above a partition that separates an outer portion of candle shell and the top of the internal housing. This partition can be called a shelf (116).

Figure 2:
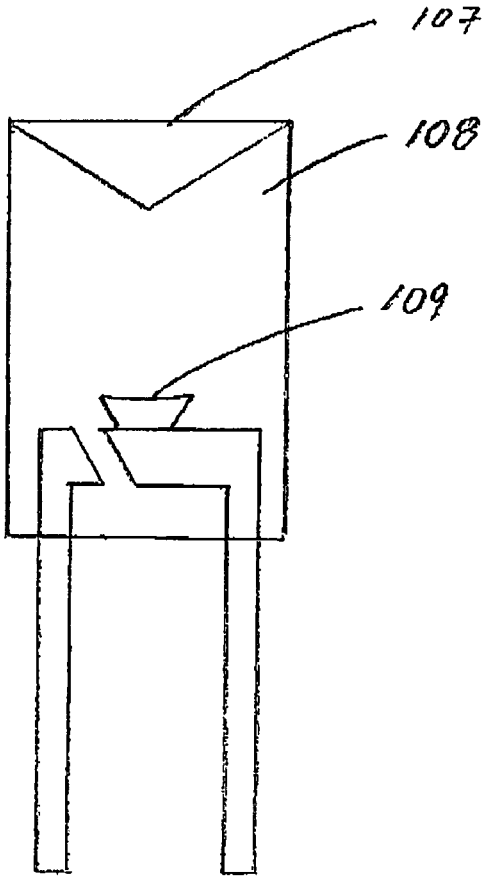
FIG. 2 shows a cross sectional view of the preferred embodiment of the colored lens LED referenced in FIG. 1.

Referring to FIG. 2, the preferred embodiment of the device includes as a light source a colored lens LED. The LED diode reflector (109) is attached to the one side of the LED. This is encased in a plastic lens (108). The plastic is colored sufficiently such that it will not impair with light performance when the LED is illuminated while appearing sufficiently black or near black when the LED is not illuminated to appear similar to a blackened candle wick. The shape of the lens in the preferred embodiment is a cylindrical body with a concave top. A concave lens has a conical indentation (107) at the top of the lens which effectively redirects light out the side of the lens rather than out the top of the lens. It may be possible under some applications to alter the shape of the lens, such as a dome shape (not shown) to tailor light performance to meet specific applications.

Figure 3:
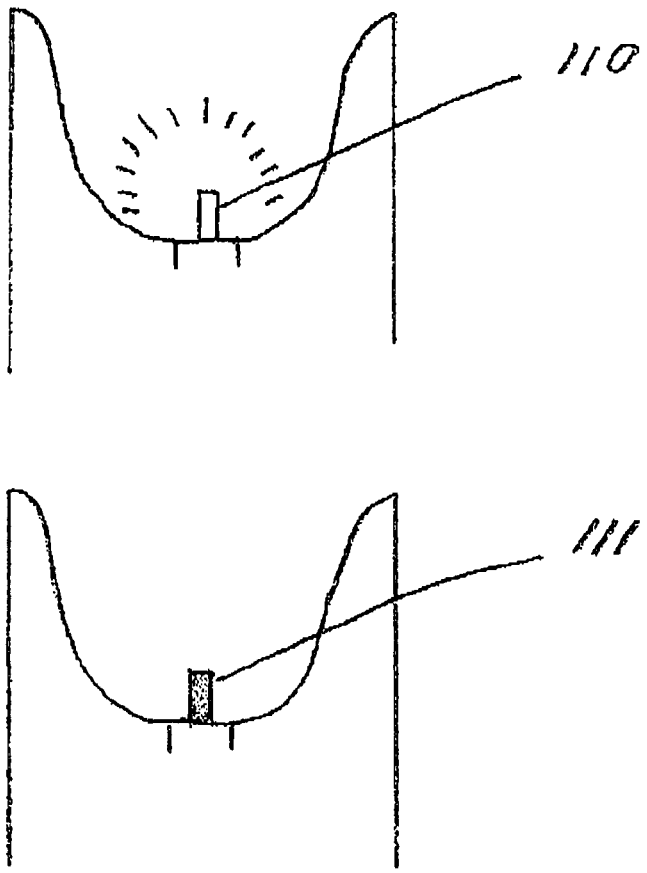
FIG. 3 shows a cross sectional interpretive view of the colored lens LED in the "on" and "off" positions.

Referring to FIG. 3, these illustrations show a cross sectional interpretive view of the colored lens LED. When "on" (110) the colored lens LED will illuminate without significant impairment from the colored lens to properly illuminate the flameless candle shell. Due to the color of the colored lens LED, when the device is "off" (111) the colored lens LED will appear black or near black. The color along with the cylindrical shape will closely resemble a blackened wick.

Figure 4:
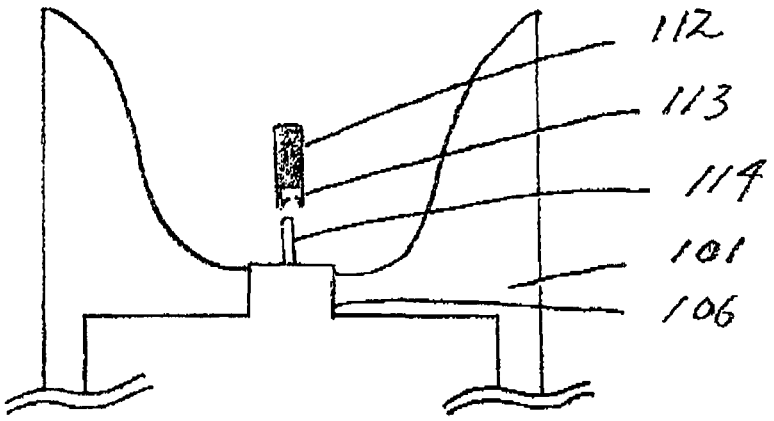
FIG. 4 shows a cross sectional interpretive view of applying a colored lens cover to a traditional clear LED as an alternative to the preferred embodiment of the device referenced in FIG. 1.

Referring to FIG. 4, this illustration shows a cross sectional view similar to that shown in FIG. 1 with the exception being the LED has a traditional clear lens (114). The traditional clear lens LED is attached to the internal housing (106) which is encased in a simulated candle shell (101) just as previously referenced in FIG. 1. A colored lens cover (112) sized to fit snuggly over the traditional clear lens LED is shown detached from the unit being described. The colored lens cover (112) is attached firmly to the internal housing (106) with the use of snap clips (113) which would mate to receptacles in the internal housing (not shown). It may be possible to use alternative forms of attachment such as gluing or screwing on the colored lens cover among several options available.

Figure 5:
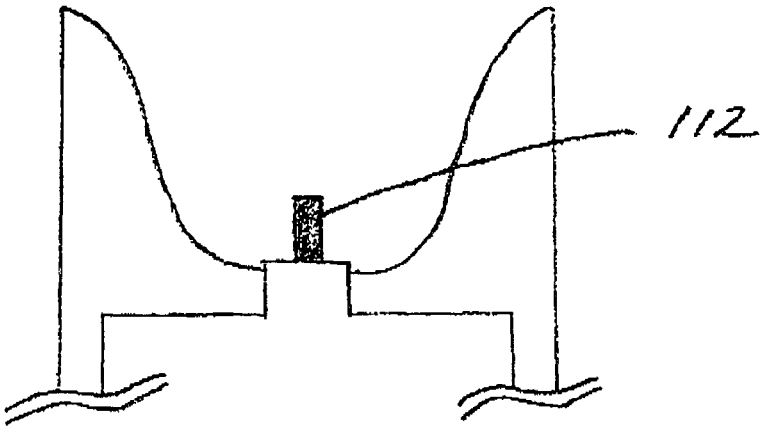
FIG. 5 shows a cross sectional interpretive view of a colored lens cover to a traditional clear LED once positioned showing a similar appearance to the preferred embodiment of the device referenced in FIG. 1.

Referring to FIG. 5, once the colored lens cover (112) placed over the traditional clear lens LED (not shown) the final appearance is functionally similar to that of the preferred embodiment of the device as shown in FIG. 1.

What is claimed:

1. A simulated candle device comprising:

a light emitting diode (LED) assembly;

an electronic circuit board to which the LED assembly is connected;

one or more switches connected to said electronic circuit board, the one or more switches configured to control power to said electronic circuit board and said LED assembly; and a simulated candle shell comprising:

an internal housing within which the electronic circuit board is mounted; and a shelf separating the internal housing from ambient, the shelf positioned above the internal housing;

wherein the LED assembly comprises an LED lamp and a simulated wick portion, the simulated wick portion extending upwardly from the shelf, the simulated wick portion having a generally cylindrical shape;

wherein the LED lamp is positioned inside the simulated wick portion extending upwardly from the shelf, such that the LED lamp is elevated above the shelf;

wherein the simulated wick portion of the LED assembly is colored such that it does not significantly impair light performance when power to the LED assembly is on and appears black or substantially black when power to the LED assembly is off.

2. The simulated candle device of claim 1, wherein the LED assembly comprises a concave shaped lens.

3. The simulated candle device of claim 1, wherein the LED assembly is controlled via an electronic circuit to intermittently illuminate to provide a flame-like flickering effect.

4. The simulated candle device of claim 1, wherein said device is connected to a power source selected from a group consisting of: one or more batteries, rechargeable batteries with removable A/C power source, a hard wired A/C power source, and solar cells.

5. The simulated candle device of claim 1, wherein said one or more switches are mounted to a control unit, said control unit being operable by a user of said device to activate said device.

6. The simulated candle of claim 1, wherein the LED lamp comprises a colored lens LED.

7. The simulated candle of claim 1, wherein the LED assembly comprises a colored lens cover over the LED lamp, and wherein the LED lamp comprises a clear LED.

8. The simulated candle of claim 1, wherein substantially the entire length of the simulated wick portion appears black or substantially black when the LED lamp is off.

9. The simulated candle of claim 1, wherein the LED assembly comprises a reflector shaped as an inverted cone, the reflector configured to direct light sideways out of the simulated candle.

10. The simulated candle of claim 1, wherein the LED lamp comprises multiple diodes.

11. The simulated candle of claim 1, wherein the LED lamp comprises a single diode.

12. A simulated candle unit comprising:

an outer shell, the outer shell comprising a chamber;

a power source positioned in the chamber;

a shelf separating the power source from ambient, the shelf being located above the chamber of the outer shell; and a lighting assembly configured to receive power from the power source and to illuminate to provide a simulation of light from a candle flame;

the lighting assembly comprising a simulated wick portion that is visible from a vantage point above the simulated candle unit, the simulated wick portion having a generally cylindrical shape and extending upwardly from the shelf, the simulated wick portion comprising a light emitting diode (LED) lamp located above the shelf, the lighting assembly configured such that:

when the lighting assembly receives power from the power source, the LED lamp emits light from a location above the shelf; and when the lighting assembly receives no or substantially no power from the power source, the simulated wick portion appears substantially black, thereby simulating an extinguished wick of a wax candle.

13. The simulated candle of claim 12, wherein substantially the entire visible portion of the simulated wick portion appears black or substantially black when the LED lamp is off.

14. The simulated candle of claim 12, wherein the LED lamp is not positioned in a flame-shaped cap.

15. The simulated candle of claim 12, wherein the lighting assembly further comprises a reflector shaped as an inverted cone, the reflector configured to direct light sideways out of the simulated candle.

16. The simulated candle of claim 12, wherein the outer shell further comprises a topmost lip, the LED lamp being positioned below the topmost lip.

17. The simulated candle of claim 12, wherein the LED lamp comprises multiple diodes.

18. The simulated candle of claim 12, wherein the LED lamp comprises a single diode.

19. The simulated candle of claim 12, wherein the power source comprises a battery.

20. The simulated candle of claim 12, wherein the power source comprises a conductor that is configured to connect with a source of power external to the simulated candle unit.

* * * * *